US009079391B2

(12) United States Patent
Kaneko et al.

(10) Patent No.: US 9,079,391 B2
(45) Date of Patent: Jul. 14, 2015

(54) INKJET HEAD AND INKJET RECORDER

(71) Applicants: Yoshiaki Kaneko, Shizuoka (JP); Takashi Kado, Shizuoka (JP)

(72) Inventors: Yoshiaki Kaneko, Shizuoka (JP); Takashi Kado, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 120 days.

(21) Appl. No.: 13/724,806

(22) Filed: Dec. 21, 2012

(65) Prior Publication Data

US 2013/0215172 A1 Aug. 22, 2013

(30) Foreign Application Priority Data

Feb. 21, 2012 (JP) ..... 2012-035319

(51) Int. Cl.
*B41J 29/38* (2006.01)
*B41J 2/045* (2006.01)

(52) U.S. Cl.
CPC ..... *B41J 2/04563* (2013.01); *B41J 2/0459* (2013.01); *B41J 2/04581* (2013.01); *B41J 2/04588* (2013.01); *B41J 2/04591* (2013.01); *B41J 2/04595* (2013.01); *B41J 2/04596* (2013.01)

(58) Field of Classification Search
USPC ..... 347/12, 11, 10, 9
See application file for complete search history.

(56) References Cited

U.S. PATENT DOCUMENTS

| | | | | |
|---|---|---|---|---|
| 4,897,665 | A * | 1/1990 | Aoki | 347/10 |
| 5,359,350 | A * | 10/1994 | Nakano et al. | 347/10 |
| 5,774,137 | A * | 6/1998 | Yoshida | 347/14 |
| 5,903,286 | A | 5/1999 | Takahashi | |
| 6,203,132 | B1 * | 3/2001 | Tsukada et al. | 347/11 |
| 6,290,315 | B1 * | 9/2001 | Sayama | 347/10 |
| 6,598,950 | B1 * | 7/2003 | Hosono et al. | 347/11 |
| 7,871,141 | B2 * | 1/2011 | Teramae | 347/10 |
| 8,434,842 | B2 * | 5/2013 | Matsuo | 347/10 |
| 2003/0001912 | A1 | 1/2003 | Kusunoki | |
| 2003/0234826 | A1 * | 12/2003 | Hosono et al. | 347/10 |
| 2005/0093903 | A1 | 5/2005 | Darling | |
| 2006/0125856 | A1 * | 6/2006 | Kitami et al. | 347/10 |

(Continued)

FOREIGN PATENT DOCUMENTS

| | | |
|---|---|---|
| JP | 2003-246055 | 9/2003 |
| JP | 2004-188932 | 7/2004 |
| JP | 2006-188043 | 7/2006 |
| JP | 2007-223310 A | 9/2007 |

(Continued)

OTHER PUBLICATIONS

Japanese Office Action, Patent Application No. 2012-035319, dated Apr. 8, 2014.

*Primary Examiner* — Matthew Luu
*Assistant Examiner* — Lily Kemathe
(74) *Attorney, Agent, or Firm* — Patterson & Sheridan, LLP

(57) ABSTRACT

According to one embodiment, an inkjet head has a pressure chamber for storing an ink, an actuator for changing the volume of the pressure chamber, and a nozzle through which the ink stored in the pressure chamber is ejected when the volume of the pressure chamber is changed. Additionally, the inkjet head has a temperature sensor for detecting the temperature of the ink and a controller for controlling the actuator by outputting an ejecting waveform. The ejecting waveform sequentially includes an expansion pulse, a first contraction pulse, and a second contraction pulse. The controller changes the pulse width or voltage value of the second contraction pulse when the temperature detected by the temperature sensor changes.

20 Claims, 6 Drawing Sheets

(56) References Cited

U.S. PATENT DOCUMENTS

| | | | | |
|---|---|---|---|---|
| 2009/0073206 | A1* | 3/2009 | Simons | 347/10 |
| 2011/0316915 | A1* | 12/2011 | Matsushita | 347/10 |
| 2012/0236052 | A1* | 9/2012 | Tobita et al. | 347/10 |

FOREIGN PATENT DOCUMENTS

| | | | |
|---|---|---|---|
| JP | 2009-154493 | | 7/2009 |
| JP | 2011-177920 | A | 9/2011 |
| JP | 2011-235638 | A | 11/2011 |

* cited by examiner

INKJET HEAD AND INKJET RECORDER

CROSS-REFERENCE TO RELATED APPLICATION

This application is based upon and claims the benefit of priority from Japanese Patent Application No. 2012-035319, filed Feb. 21, 2012; the entire contents of which are incorporated herein by reference.

FIELD

Embodiments described herein relate to an inkjet head that ejects ink to form a picture on a recording medium, and an inkjet printer/recorder.

BACKGROUND

For an inkjet head used in an inkjet printer or the like, ink is ejected selectively from a plurality of nozzles to form a picture on a recording medium.

As a method for ejecting ink from the nozzles of the inkjet head, there is the following method: the volume of a pressure chamber arranged for each nozzle is changed by an actuator and the ink in the pressure chamber is ejected when the volume of the pressure chamber is decreased by the actuator.

When the ink is ejected from a nozzle using such a method, the ink in the pressure chamber vibrates. It is assumed that such vibration (hereinafter to be referred to as residual vibration) has an adverse influence on subsequent ink ejections and may impact the quality of the printed image produced by the printer. This vibration problem can be alleviated/mitigated by forming an appropriate voltage waveform (driving signal) for driving the actuator.

However, as the viscosity of the ink varies with temperature, the damping state of the residual vibration of the ink also varies. Consequently, the residual vibration in the pressure chamber cannot be suppressed appropriately by only using a single sequence of voltage waveforms (driving signals) for driving the actuator.

The challenge is to provide an inkjet head that can suppress the residual vibration after ink ejection even with changes in ink temperature, so that high quality pictures can be formed, and to provide an inkjet printer/recorder having such an inkjet head.

DETAILED DESCRIPTION

In general, embodiments of the present disclosure will be explained with reference to figures.

An inkjet head according to an embodiment of the present disclosure has a pressure chamber for storing ink, an actuator that changes the volume of the pressure chamber, a nozzle or nozzles through which ink is ejected from the pressure chamber when the volume of the pressure chamber is varied, a temperature sensor that detects the temperature of the ink, and a controller, which outputs an ejecting waveform sequentially containing an expansion pulse for expanding the volume of the pressure chamber, a first contraction pulse for contracting the volume of the pressure chamber and a second contraction pulse for contracting the volume of the pressure chamber as a driving signal to the actuator. The controller varies the pulse width or voltage value of the second contraction pulse when the temperature of the ink detected by the temperature sensor varies. For example, the controller may decrease the pulse width or voltage value of the second contraction pulse in the ejecting waveform when the temperature detected by the temperature sensor becomes higher.

Embodiment 1

Figure 1:
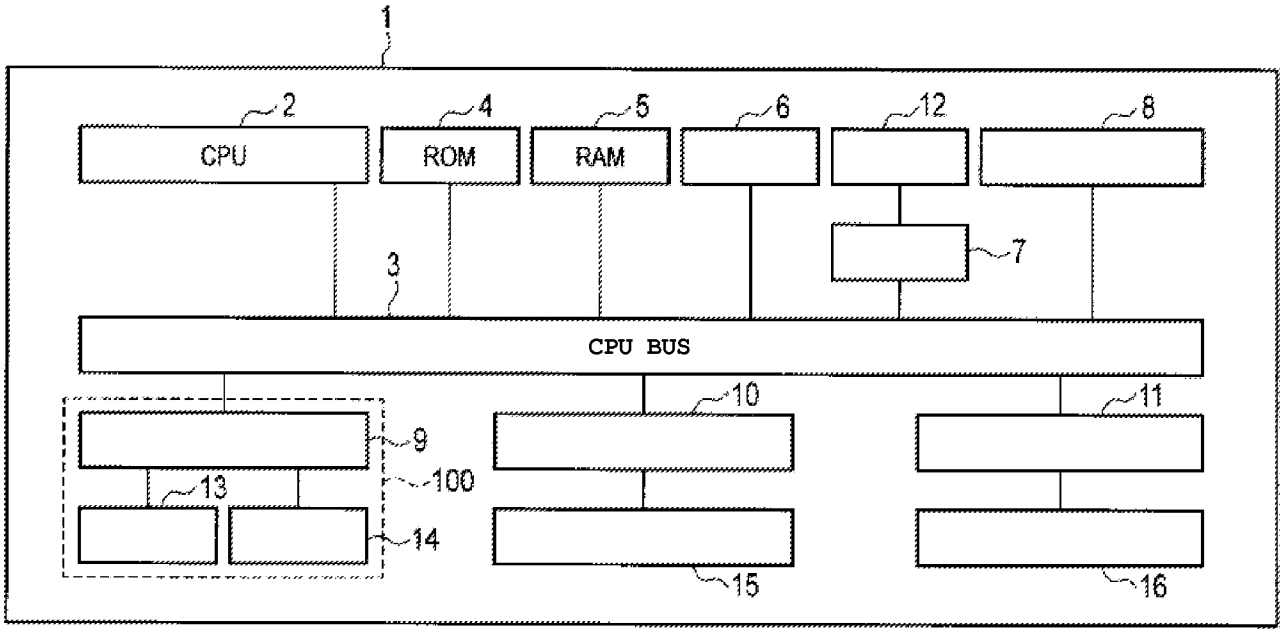
FIG. 1 is a diagram illustrating the components of a main portion of the inkjet recorder related to a first embodiment of the present disclosure.

FIG. 1 is a diagram illustrating the components of a main portion of the inkjet recorder according to Embodiment 1.

The inkjet recorder 1 according to this embodiment has a CPU (central processing unit) 2 that functions as a control center. The following parts are connected to the CPU 2 via a CPU bus 3: a ROM (read-only memory) 4, a RAM (random access memory) 5, a data memory 6, an input port 7, an interface 8, a drive signal controller 9 (controller), a head maintenance controller 10, a media transporting controller 11, etc. In addition, an operation panel 12 is connected to the input port 7, a temperature sensor 13 and a head 14 are connected to the drive signal controller 9, a head maintenance device 15 is connected to the head maintenance controller 10, and a media transporting device 16 (transporting device) is connected to the media transporting controller 11.

The CPU 2 executes various types of functions/treatments related to control of the inkjet recorder 1. The ROM 4 has the control programs for realizing various functions/treatments executed in the CPU 2 and the fixed values, parameters, etc., used in the functions/treatments stored in it. The RAM 5 has storage regions for various types of operations corresponding to the various treatment scenarios.

Stored in data memory 6 are the image data input from the outside the inkjet recorder 1 and the spread data as a collection of tone value data that convert each of the pixels contained in the image data to an ejection number (drop number) of the ink drops.

The operation panel 12 contains various types of operation buttons, a display unit equipped with a touch panel, or similar user interface components. Operation panel is used to input the information related to the start of printing and the printing condition parameters, or similar information. The operation panel 12 also shows the control state of the inkjet recorder 1 by displaying information, for example, status information, on the display.

The interface 8 is connected with a cable or the like for communication with a host computer and other external equipment.

The drive signal controller 9, the temperature sensor 13, and the head 14 form the inkjet head 100. Details of the drive signal controller 9, the temperature sensor 13 and the head 14 will be explained with reference to FIGS. 2 and 3.

The head maintenance device 15 can move towards the head 14 to clean the nozzle surface of the head 14. The head maintenance controller 10 controls the head maintenance device 15.

Media transporting device 16 includes, for example, a pickup roller the picks up a paper sheet as the recording medium from a paper sheet cassette (not shown in the figure), a suction drum that sucks the paper sheet picked up by the roller on its outer peripheral surface and transports the paper sheet to the ink ejecting position by the head 14, a separating mechanism that separates the paper sheet from the drum after the formation of the picture by the head 14, a paper releasing roller that exhausts the paper sheet separated by the separating mechanism to a released paper tray, and similar or related components. The media transporting controller 11 controls the various parts of the media transporting device 16.

In the following, the details of the various parts that form the inkjet head 100 will be explained.

Figure 2:
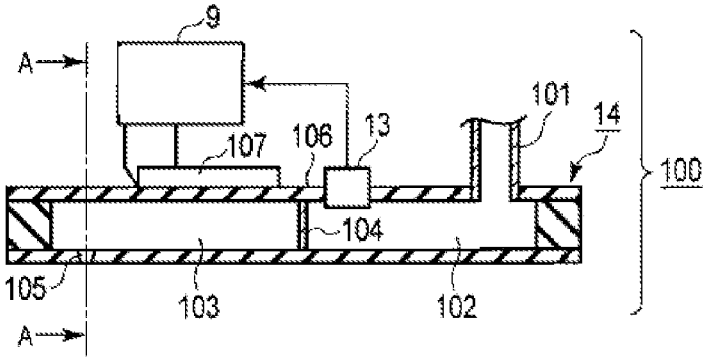
FIG. 2 is a diagram illustrating the components of an inkjet head according to the first embodiment.

As shown in FIG. 2, a cross-sectional view, the head 14 has the following parts: an ink inlet 101 connected to an ink cartridge or other ink supply source (not shown), a common pressure chamber 102 that accommodates the ink flowing in through the ink inlet 101, a plurality of pressure chambers 103 filled with the ink from the common pressure chamber 102, a partition wall 104 that separates these pressure chambers 103 and the common pressure chamber 102, a plurality of nozzles 105 connected to the pressure chambers 103 for ejecting the ink, a plurality of vibration plates 106 that form one wall surface for each of the various pressure chambers 103, and a plurality of piezoelectric elements 107 arranged on the vibration plates 106, respectively. The temperature sensor 13 is disposed at a site where it can detect the temperature of the ink in the common pressure chamber 102. The drive signal controller 9 is connected to the vibration plates 106 and the temperature sensor 13.

Figure 3:
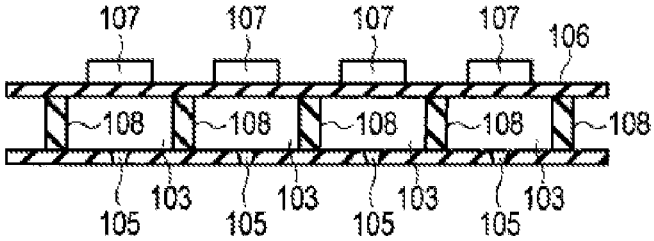
FIG. 3 is a cross-sectional view taken across line A-A of FIG. 2.

FIG. 3 is a cross-sectional view taken across A-A of FIG. 2. It can be seen that the pressure chambers 103 are adjacent to each other separated by partition wall 108.

The vibration plates 106 and piezoelectric elements 107 form a plurality of actuators that change the volumes of the pressure chambers 103.

In synchronization with a transport rate of the paper sheet by the media transporting device 16, the drive signal controller 9 outputs the drive voltage signals to the corresponding piezoelectric elements 107 for ejecting ink drops, the number of ink drops ejected from a nozzle 105 corresponding to the tone (gradation) value data of the various pixels contained on each image line, respectively, in order, from the head line of the spread data stored in the data memory 6.

The drive voltage signal to an actuator can include a combination of ejecting waveforms each waveform for ejecting a separate ink drop.

Figure 4:
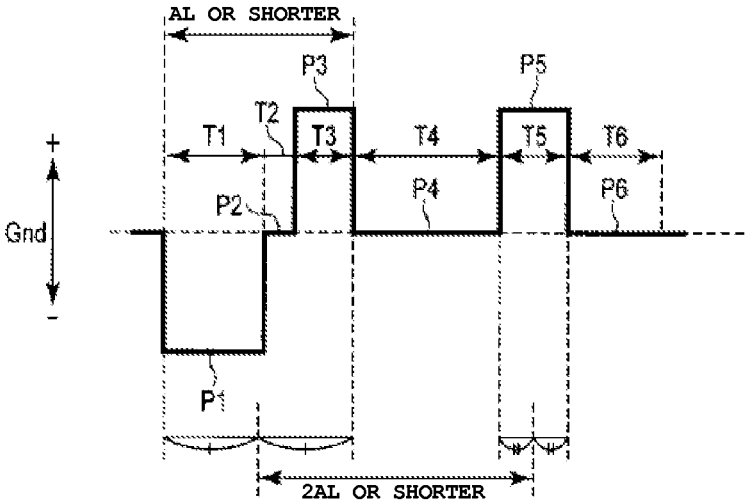
FIG. 4 is a diagram illustrating an example ejecting waveform of the embodiment.

As shown in FIG. 4, each ejecting waveform sequentially contain an expansion pulse P1 that expands the volume of the pressure chamber 103, a ground potential (pulse pause) P2 for allowing the pressure chamber 103 to reach steady state after the expansion of the pressure chamber 103 by the expansion pulse P1, a first contraction pulse P3 for contracting the volume of the pressure chamber 103, a ground potential (pulse pause) P4 for allowing the pressure chamber 103 to reach steady state after the change of the volume of the pressure chamber 103 caused the first contraction pulse P3, a second contraction pulse P5 for contracting the volume of the pressure chamber 103, and a ground potential (pulse pause) P6 for allowing the pressure chamber 103 to reach steady state after the change in the volume of the pressure chamber 103 caused by the second contraction pulse P5.

According to the present embodiment, a 4-tone multi-drop system is used as an example. In a 4-tone multi-drop system, the ejecting waveform may be repeated up to 3 cycles in the drive signal output to the same actuator, with one pixel being formed on the paper sheet with a tone/gradation corresponding to zero to three ink drops dispensed through the nozzle by the actuator. That is, a first pixel tone would correspond to zero ink drops dispensed, a second pixel tone would correspond to one ink drop dispensed, a third pixel tone would correspond to two ink drops dispensed, etc.

As depicted, the expansion pulse P1 has a negative polarity, and the first contraction pulse P3 and the second contraction pulse P5 have a positive polarity. However, one may also use a scheme wherein the polarities of the expansion pulse P1 and the first contraction pulse P3 and second contraction pulse P5 are swapped, the volume of the pressure chamber 103 is expanded by the positive polarity expansion pulse P1, and the volume of the pressure chamber 103 is contracted by the negative polarity first contraction pulse P3 and second contraction pulse P5.

Here, the pulse width (time period) of the expansion pulse P1 is T1, the time period of the ground potential (pulse pause) P2 is T2, the pulse width (time period) of the first contraction pulse P3 is T3, the time period of the ground potential (pulse pause) P4 is T4, the pulse width (time period) of the second contraction pulse P5 is T5, and the time period of the ground potential (pulse pause) P6 is T6. The time period from the starting point of the expansion pulse P1 to the end of the first contraction pulse P3 (T1+T2+T3) is set to be shorter than half of the resonance period between the ink in the pressure chamber 103 and the pressure chamber 103 (half of the resonance period=AL). The time period from the middle point of the period that includes the starting point of the expansion pulse P1 to the end of the first contraction pulse P3 (said middle point coincidentally corresponds to the start of P2 in FIG. 4) and up to the middle point of the second contraction pulse P5 is set to be shorter than the resonance period (resonance period=2AL). The resonance period is a function of the structure of the pressure chamber 103 and the characteristics of the ink and can be referred to as a Helmholtz resonance period.

Figure 5:
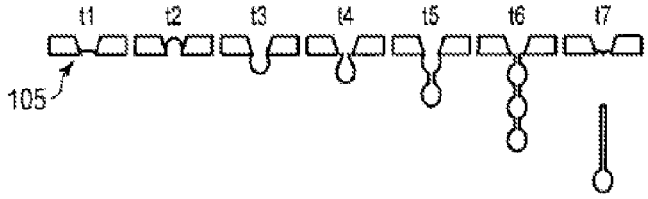
FIG. 5 is a diagram illustrating a state of ejection of the ink drops from a nozzle.

FIG. 5 is a diagram illustrating the states of ejection of ink drops from the nozzles 105 when an ejecting waveform is input to the respective piezoelectric elements 107.

In the state before input of the ejecting waveform, the meniscus of ink formed inside the nozzles 105 is undisturbed (time t1). Next, for example, when ejecting waveforms for 3 drops are input consecutively to the piezoelectric elements 107, at the start of the input of the first ejecting waveform, the meniscus in the nozzle 105 starts to vibrate (times t2, t3). Immediately after the end of input of the ejecting waveforms the pressure wave generated in the pressure chamber 103 due to the operation of the actuator corresponding to the first ejecting waveform causes the first ink drop to be ejected from the nozzle 105 (time t4). Next, under the influence of the pressure waves generated in the pressure chamber 103 due to the operation of the actuator corresponding to the second and third ejecting waveforms, the second and third ink drops are ejected from the nozzle 105 (times t5, t6). The 3 ink drops are integrated with each other in space to form a single combined/integrated ink drop (time t7), and then the integrated ink drop strikes the recording medium. The relationship between the input timing of the ejecting waveforms and the ejected ink drops ejected from the nozzle 105 is merely an example. In practice, this relationship varies depending on the shapes of the pressure chamber 103 and the nozzle 105, the shape of the ejecting waveform, the type of ink, among other factors.

Figure 6:
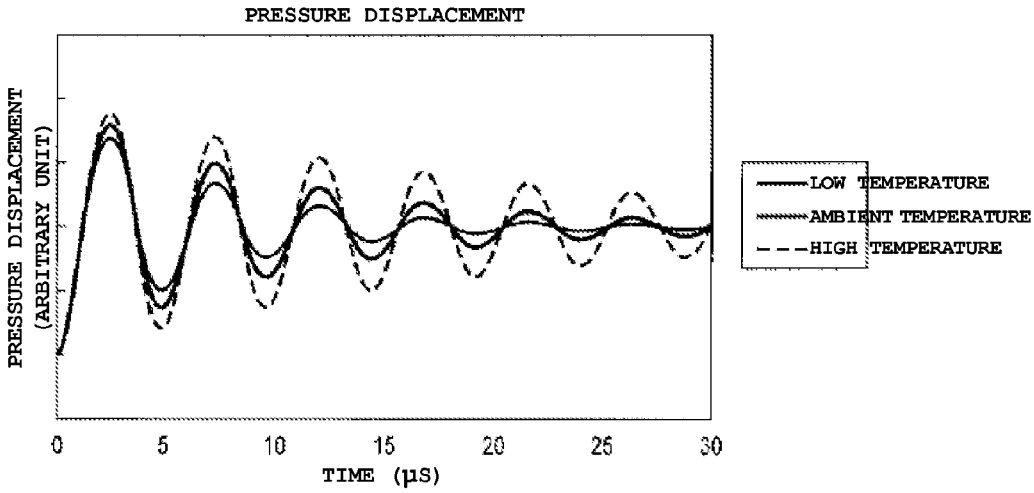
FIG. 6 is a diagram illustrating a state of the residual vibration in a pressure chamber.

FIG. 6 is a diagram illustrating the state of the residual vibration in the pressure chamber 103 after the ink is ejected from the nozzle 105, when the temperature of the ink is at a low temperature, room temperature, and a high temperature, respectively. In this figure, the abscissa represents the time (μs—microseconds, $1\times10^{-6}$ seconds) and the ordinate represents the pressure displacement (in an arbitrary unit) from the steady state (equilibrium) condition.

As seen in FIG. 6, the residual vibration is smaller when the viscosity of the ink is higher (corresponding to low temperatures). The viscosity of the ink decreases as the ink temperature increases. As can be seen from this FIG. 6, the higher the ink temperature, the more difficult it is to dampen the residual vibration. Consequently, when the ink temperature is higher (and ink viscosity low), it is necessary to significantly adjust the pulse width and voltage of each of the pulses contained in the ejecting waveform and the timing of pulse input to the piezoelectric element 107, so as to suppress the residual vibration.

Figure 7:
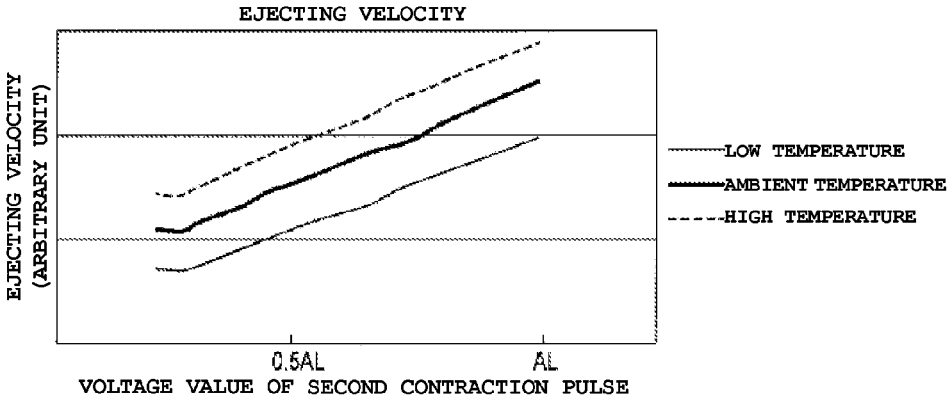
FIG. 7 is a diagram illustrating a relationship between the pulse width of the second contraction pulse and the ejecting velocity of an ink drop.

In the following, the relationship between the pulse width T5 of the second contraction pulse P5 and the residual vibration will be explained. FIG. 7 is a graph showing the results of an experimental measurement of the relationship between the ejecting velocity of the ink drop ejected from the nozzle 105 when the 3-drop ejecting waveform is supplied to the actuator with the pulse width T5 at low temperature, ambient temperature, and high temperature of the ink, respectively. In this graph, the abscissa represents the pulse width T5 (μs) of the second contraction pulse P5 and the ordinate represents the ejecting velocity (in an arbitrary unit) of the ink drop ejected from the nozzle 105. The measurement range is 0 (μs)<pulse width T5<AL (μs). The actual ejecting velocity varies corresponding to the specifics of the ink type, the shapes of the pressure chamber 103 and the nozzle 105, the performance of the actuator, etc.

The ejecting velocity of the ink drop will tend to increase as the pulse width T5 becomes longer at a low temperature, ambient temperature, or high temperature. This tendency is caused by the following fact: because the vibration generated due to the operation of the actuator corresponding to each ejecting waveform is not cancelled out the influence of the residual vibration generated by the ejecting waveforms amplifies the pressure in the pressure chamber 103, so that the ejecting energy of the ink drops becomes higher.

That is, the longer the pulse width T5, the higher the ejection efficiency. Here, the ejection efficiency refers to the proportion of the energy of the ejected ink drop compared to the energy input to the actuator. However, while a longer pulse width T5 may improve ejection efficiency, the residual vibration also becomes larger when the pulse width T5 is increased. On the other hand, when the pulse width T5 is shorter the ejection efficiency is lower, but the residual vibration is also smaller. The residual vibration may have an adverse influence on the ejection of the subsequent ink drops. When the ink temperature is low, damping of the residual vibration becomes easier due to increased ink viscosity.

As shown in FIG. 6, when the ink temperature is low and the pulse width T5 is increased so that the ejecting velocity may be high, ejection of the subsequent ink drops will be influenced only slightly. On the other hand, when the ink temperature is high, the residual vibration may not be sufficiently damped, so that it is necessary to shorten the pulse width T5 to suppress the residual vibration.

The pulse width T5 can be adjusted according to requirements related to the residual vibration, and the ejecting velocity. Specifically, the pulse width T5 can be set based on the ink temperature so as to achieve a desired ejecting velocity while suppressing the residual vibration below levels which might degrade the quality of the printed image. For example, the pulse width T5 of the second contraction pulse P5 contained in the ejecting waveform as shown in FIG. 8 becomes shorter as the temperature detected by the temperature sensor 13 increases.

Figure 8:
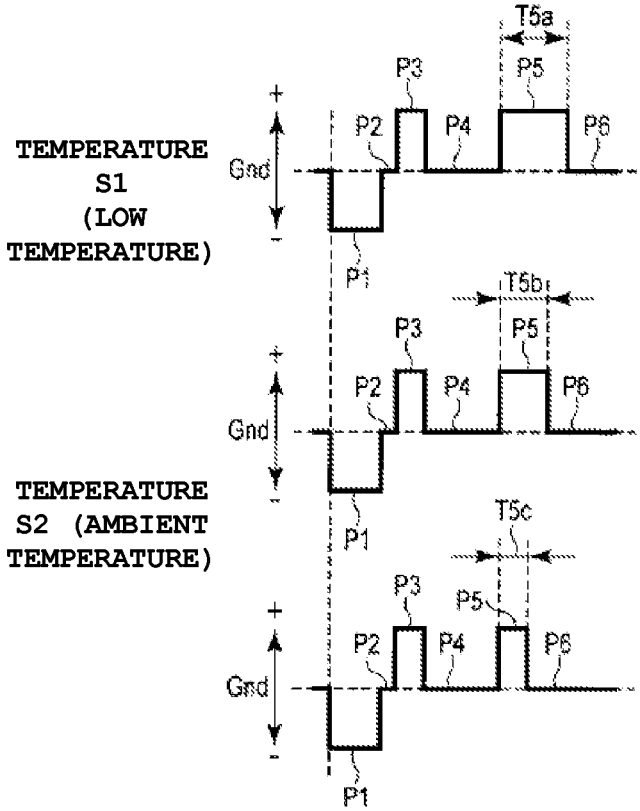
FIG. 8 is a diagram illustrating example ejecting waveforms at certain temperatures according to embodiments of the present disclosure.

FIG. 8 shows the ejecting waveforms generated at temperature S1 (low temperature), temperature S2 (ambient temperature: S1<S2), and temperature S3 (high temperature: S2<S3). Supposing that the ink temperature equals temperature S1, then the second contraction pulse P5 has a pulse width T5*a*. And when the ink temperature equals temperature S2 the second contraction pulse P5 has a pulse width of T5*b* and at temperature S3 the second contraction pulse P5 has a pulse width of T5*c*. The pulse widths are in the relationship of T5*c*<T5*b*<T5*a*. The pulse width T5 of the second contraction pulse P5 as function of the ink temperature can be determined on the basis of, for example, a pre-determined formula or table. Such a formula or table may be determined from experiments, experience, or theory so that the pulse width T5 that can most efficiently damp the residual vibration within a range wherein the desired ejecting velocity can be obtained can be determined on the basis of the ink temperature. Here, the pulse width T5 that can most efficiently damp the residual vibration also varies corresponding to the ink type, the shapes of the pressure chamber 103 and the nozzle 105, the performance of the actuator, etc. Consequently, these parameters also should be taken into consideration in determining the formula or table used to set the pulse width T5.

Also, the value of the Helmholtz resonance period varies depending on the ink temperature. Here, the drive signal controller 9 computes the value of the Helmholtz resonance period using a pre-determined formula, algorithm, or the like on the basis of the ink temperature determined by the temperature sensor 13, and it adjusts the periods T1, T2 and T3 of the expansion pulse P1, ground potential P2, and first contraction pulse P3 so that the relationship between the AL and the expansion pulse P1, ground potential P2, and first contraction pulse P3 (T1+T2+T3≤AL) explained above with reference to FIG. 4 is satisfied. One may also use a scheme in which the values of the periods T1, T2, T3 are determined so that the relationship is satisfied within an assumed range of likely temperatures of the environment in which the inkjet recorder 1 will be used.

In addition, corresponding to the value of the Helmholtz resonance period computed at the ink temperature detected with the temperature sensor 13, the drive signal controller 9 sets the output timing of the second contraction pulse P5 so that the relationship between the AL and the second contraction pulse P5 is such that, as explained with reference to FIG. 4, the period from the middle point of the period that includes the starting point of the expansion pulse P1 to the end of the first contraction pulse P3, and up to the middle point of the second contraction pulse P5 is 2AL or shorter (that is, (T1+T2+T3)/2+T4+T5/2≤2AL). The output timing of the second contraction pulse P5 may be set by adjusting, for example, the time period T4 of the ground potential P4.

As explained above, with the inkjet head 100 and the inkjet recorder 1 according to the present embodiment, the required pulse width T5 of the second contraction pulse P5 decreases as the temperature of the ink detected by the temperature sensor 13 rises. As a result, while the desired ejecting velocity is maintained, it is possible to appropriately suppress the residual vibration that is generated in the pressure chamber 103 when ink ejection takes place. Thus, an excellent printed image may be formed independent of the temperature of the ink.

Embodiment 2

The constitution of the inkjet recorder 1 shown in FIG. 1, the constitution of the inkjet head 100 shown in FIGS. 2 and 3, and the constitution of the ejecting waveform shown in FIG. 4 in Embodiment 2 are the same as those in Embodiment 1.

Figure 9:
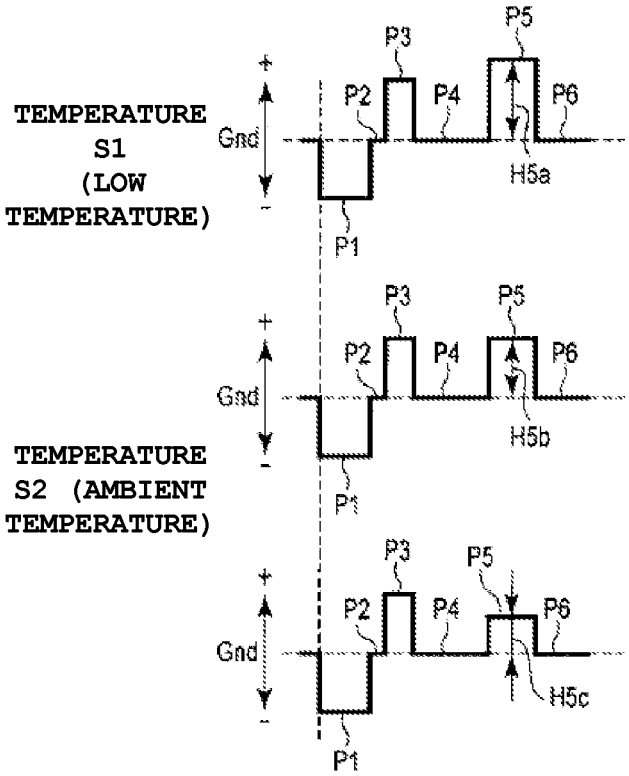
FIG. 9 is a diagram illustrating example ejecting waveforms at certain temperatures according to a second embodiment of the present disclosure.

However, the drive signal controller 9 in this embodiment controls so that as the temperature detected by the temperature sensor 13 rises, the pulse width T5 of the second contraction pulse P5 is not decreased; instead, as shown in FIG. 9, as the temperature detected by the temperature sensor 13 rises, the voltage value (voltage magnitude) of the second contraction pulse P5 is decreased.

In FIG. 7, the abscissa of the graph represents the voltage value of the second contraction pulse P5. In this case, the same relationship as that of the line shown in the same figure exists when the ink temperature is at low temperature, ambient temperature, or high temperature. That is, at any of the temperatures, as the voltage value of the second contraction pulse P5 is increased, the ejection efficiency becomes higher, while the residual vibration also increases. Conversely, at any of the temperatures, when the voltage value of the second contraction pulse P5 is decreased, the ejection efficiency falls and the residual vibration also decreases. In addition, when the voltage value of the second contraction pulse P5 is constant, the ejection efficiency becomes higher as the ink temperature rises.

Judging from this relationship, it can be seen that by incorporating the second contraction pulse P5 with its voltage value adjusted corresponding to the ink temperature to the ejecting waveform, it is possible to efficiently dampen the residual vibration.

FIG. 9 is a diagram illustrating the ejecting waveforms generated at the temperature S1 (low temperature), temperature S2 (ambient temperature: S1<S2), and temperature S3 (high temperature: S2<S3). Supposing that the voltage value at temperature S1 of the second contraction pulse P5 is H5*a*, the voltage value at temperature S2 is H5*b*, and the voltage value at temperature S3 is H5*c*, there is the relationship of H5*c*<H5*b*<H5*a* between the voltage values. The voltage value H5 of the second contraction pulse P5 can be determined for an ink temperature on the basis of, for example, a pre-determined formula or a look-up table. Such a formula and table may be determined from experiments, experience, or theory, so that the voltage value H5 that can most efficiently damp the residual vibration within the range wherein the desired ejecting velocity can be obtained can be determined on the basis of the ink temperature. Here, the voltage value H5 that can most efficiently damp the residual vibration also varies corresponding to the ink type, the shapes of the pressure chamber 103 and the nozzle 105, the performance of the actuator, etc. Consequently, these parameters also should be taken into consideration in determining the formula or table.

Also, the drive signal controller 9 computes the value of the Helmholtz resonance period using a pre-determined formula or the like on the basis of the ink temperature determined by the temperature sensor 13, and it adjusts the periods T1, T2 and T3 of the expansion pulse P1, ground potential P2, and first contraction pulse P3 so that the relationship between the AL and the expansion pulse P1, ground potential P2, and first contraction pulse P3 (T1+T2+T3≤AL), explained above with reference to FIG. 4, is satisfied. One may also use a scheme in which the values of the periods T1, T2, T3 are determined so that the relationship is satisfied within an assumed range of likely temperatures of the environment in which of the inkjet recorder 1 will be used.

In addition, corresponding to the value of the Helmholtz resonance period computed corresponding to the ink temperature detected with the temperature sensor 13, the drive signal controller 9 sets the output timing of the second contraction pulse P5 so that the relationship between the AL and the second contraction pulse P5 as explained with reference to FIG. 4 (that is, the relationship in which the period from the middle point of the period from the starting point of the expansion pulse P1 to the end of the first contraction pulse P3, up to the middle point of the second contraction pulse P5 is 2AL or shorter ((T1+T2+T3)/2+T4+T5/2≤2AL)) is satisfied. The output timing of the second contraction pulse P5 may be set by adjusting, for example, the time period T4 of the ground potential P4.

As explained above, with the inkjet head 100 and the inkjet recorder 1, the voltage value H5 of the second contraction pulse P5 required to achieve a desired ejection velocity decreases as the temperature of the ink rises. As a result, while the desired ejecting velocity is maintained, it is possible to appropriately suppress the residual vibration, which is generated in the pressure chamber 103 when ink ejection takes place. Thus, independent of the temperature an excellent printed image may be formed.

Embodiment 3

When a pixel is formed by a multi-drop system, there is, in addition to the problem related to the residual vibration, a problem related to deviation in the striking points (impact locations of the drops on the paper/recording medium) of the plurality of ink drops ejected from the nozzle 105 for forming the pixel.

Figure 10:
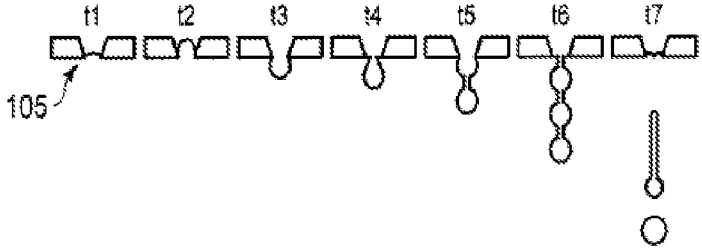
FIG. 10 is a diagram illustrating the ink ejection in the multi-drop system.

In the following, this problem will be explained with reference to FIGS. 5 and 10. As shown in FIG. 5, a plurality of ink drops ejected from the nozzle 105 are integrated in space (time t7), then strike the recording medium. When this occurs, there is no deviation in the striking points of the various ink drops. It is, thus, possible to form a high quality multi-tone picture on the recording medium. However, if the ejecting velocity of the subsequent ink drop is slower than that of the preceding ink drop, as shown in FIG. 10, the preceding ink drop and the subsequent ink drop will not be integrated (time t7), and the striking points of the various ink drops may deviate from each other, which may lead to degradation in the image quality.

In consideration of this problem, according to the present embodiment, the following scheme is used: the pulse width T5 of the second contraction pulse P5 is adjusted so that the ejecting velocity of the subsequent ink drop is higher than the preceding drop to ensure reliable integration of the various ink drops. The constitution of the inkjet recorder 1 shown in FIG. 1, the constitution of the inkjet head 100 shown in FIGS. 2 and 3, and the constitution of the ejecting waveform shown in FIG. 4 according to this embodiment are the same as those in Embodiment 1. Consequently, they will not be explained in detail again.

Figure 11:
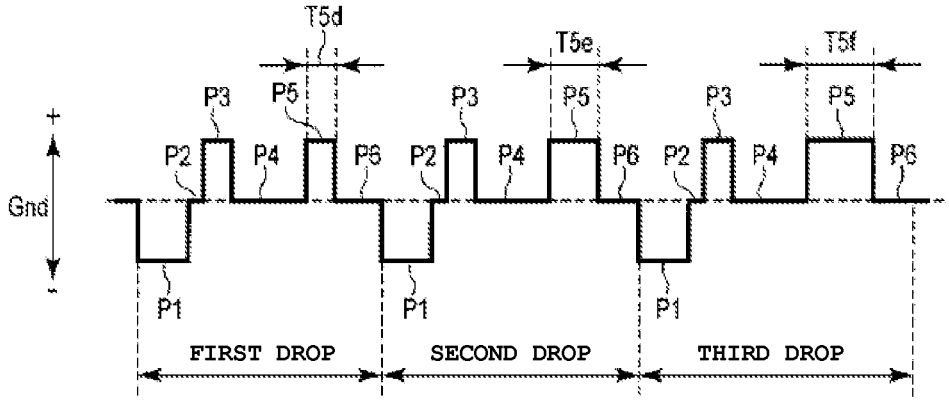
FIG. 11 is a diagram illustrating an example ejecting waveform for 3 drops according to a third embodiment of the present disclosure.

As shown in FIG. 7, when a 3-drop ejecting waveform is fed to the actuator, there is a tendency for the ejecting velocity of the ink drop to increase as the pulse width T5 of the second contraction pulse P5 becomes larger. This relationship also stands for the ejecting velocity of the ink drop ejected from the nozzle 105 when a 1-drop ejecting waveform is fed to the actuator. As a result, on the basis of the relationship between the pulse width T5 of the second contraction pulse P5 and the ejecting velocity of the ink drop, the drive signal controller 9 of the present embodiment sets the ejecting waveform consecutively output to form a pixel so that the pulse width is T5*d* for the second contraction pulse P5 contained in the ejecting waveform corresponding to a pixel shown in FIG. 11, the pulse width is T5*e* (T5*d*<T5*e*) for the second contraction pulse P5 contained in the ejecting waveform corresponding to the second ink drop, and the pulse width is T5*f* (T5*e*<T5*f*) for the second contraction pulse P5 contained in the ejecting waveform corresponding to the third ink drop.

Also, for each of the ejecting waveforms corresponding to the first through third ink drops, the drive signal controller 9 computes the value of the Helmholtz resonance period on the basis of the ink temperature determined by the temperature sensor 13, and it adjusts the periods T1, T2 and T3 of the expansion pulse P1, ground potential P2 and first contraction pulse P3 so that the relationship between the AL and the expansion pulse P1, ground potential P2, and first contraction pulse P3 (T1+T2+T3≤AL) explained above with reference to FIG. 4 is satisfied. One may also use a scheme in which the values of the periods T1, T2, T3 are fixed so that the relationship is satisfied within an assumed range of likely temperatures of the environment in which the inkjet recorder 1 will be used.

In addition, corresponding to the value of the Helmholtz resonance period computed corresponding to the ink temperature detected with the temperature sensor 13, for each of the ejecting waveforms corresponding to the ink drops as the first through third drops, the drive signal controller 9 sets the output timing of the second contraction pulse P5 so that the relationship between the AL and the second contraction pulse P5 as explained with reference to FIG. 4 (that is, the relationship in which the period that includes the middle point of the period from the starting point of the expansion pulse P1 to the end of the first contraction pulse P3, and up to the middle point of the second contraction pulse P5 is 2AL or shorter ((T1+T2+T3)/2+T4+T5/2≤2AL)) is satisfied. The output timing of the second contraction pulse P5 may be set by adjusting, for example, the period T4 of the ground potential P4.

As explained above, according to the present embodiment, for the ejecting waveform of the subsequent ink drop, the pulse width T5 of the second contraction pulse P5 is made larger, so that the ejecting velocity of the subsequent ink drop is made higher, so that various ejected ink drops integrate. This scheme is not limited to the case in which a pixel is represented by 0 to 3 drops. It may also be used when more drops are used to represent a pixel and when fewer drops are used to represent a pixel.

Embodiment 4

The constitution of the inkjet recorder 1 shown in FIG. 1, the constitution of the inkjet head 100 shown in FIGS. 2 and 3, and the constitution of the ejecting waveform shown in FIG. 4 are the same as those in Embodiment 1. Also, the manner in which the various second contraction pulses P5 contained in the ejecting waveforms consecutively output to form a pixel are sequentially adjusted is the same as in Embodiment 3.

However, in this embodiment, the drive signal controller 9 does not change the pulse width T5 of the second contraction pulse P5 contained in each ejecting waveform. Instead, as shown in FIG. 12, the voltage value H5 of the second contraction pulse P5 is made higher for the ejecting waveform corresponding to the subsequent drop.

Figure 12:
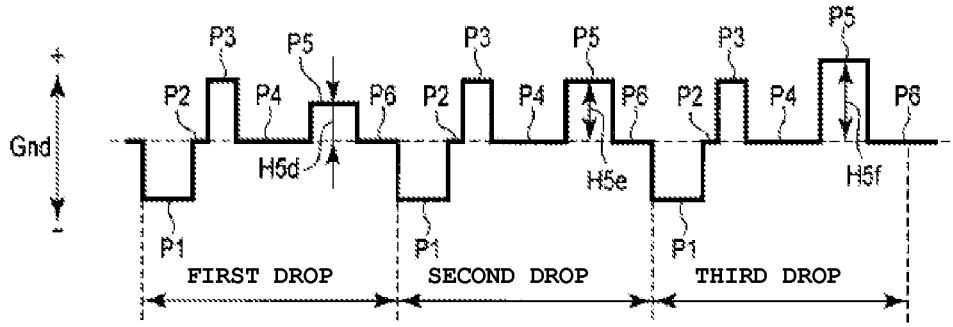
FIG. 12 is a diagram illustrating an example ejecting waveform for 3 drops according to a fourth embodiment of the present disclosure.

FIG. 12 is a diagram illustrating the three ejecting waveforms output consecutively to form a pixel. In this embodiment, the drive signal controller 9 sets the voltage value H5*d* for the second contraction pulse P5 contained in the ejecting waveform corresponding to the first ink drop, it sets the voltage value H5*e* (H5*d*<H5*e*) for the second contraction pulse P5 contained in the ejecting waveform corresponding to the second ink drop, and it sets the voltage value H5*f* (H5*e*<H5*f*) for the second contraction pulse P5 contained in the ejecting waveform corresponding to the third ink drop.

Also, for each of the ejecting waveforms corresponding to the first through third ink drops, the drive signal controller 9 computes the value of the Helmholtz resonance period on the basis of the ink temperature determined by the temperature sensor 13, and it adjusts the periods T1, T2 and T3 of the expansion pulse P1, ground potential P2 and first contraction pulse P3 so that the relationship between the AL and the expansion pulse P1, ground potential P2, and first contraction pulse P3 (T1+T2+T3≤AL) explained above with reference to FIG. 4 is satisfied. One may also use a scheme in which the values of the periods T1, T2, T3 are fixed so that the relationship is satisfied within an assumed range of likely temperatures of the environment in which the inkjet recorder 1 will be used.

In addition, corresponding to the value of the Helmholtz resonance period computed corresponding to the ink temperature detected with the temperature sensor 13, for each of the ejecting waveforms corresponding to the first through third ink drops, the drive signal controller 9 sets the output timing of the second contraction pulse P5 so that the relationship between the AL and the second contraction pulse P5 as explained with reference to FIG. 4 (that is, the relationship in which the period that includes the middle point of the period from the starting point of the expansion pulse P1 to the end of the first contraction pulse P3, and up to the middle point of the second contraction pulse P5 is 2AL or shorter ((T1+T2+T3)/2+T4+T5/2≤2AL)) is satisfied. The output timing of the second contraction pulse P5 may be set by adjusting, for example, the period T4 of the ground potential P4.

As explained with reference to Embodiment 2, when the 3-drop ejecting waveform is fed to the actuator, there is a tendency for the ejecting velocity of the ink drop to increase as the voltage value H5 of the second contraction pulse P5 increases. This relationship also holds for the ejecting velocity of the ink drop ejected from the nozzle 105 when a 1-drop ejecting waveform is fed to the actuator. Consequently, by changing the voltage value H5 of the second contraction pulse P5 as mentioned previously, it is possible to have a higher ejecting velocity of the subsequent ink drop, so that the various ink drops can be integrated with each other before they strike the printing medium.

MODIFIED EXAMPLES

The various additional arrangements can be formed by appropriate modification or combination of the disclosed Embodiments 1 to 4.

For example, Embodiment 1, wherein the pulse width T5 of the second contraction pulse P5 is changed corresponding to the ink temperature, and Embodiment 2, wherein the voltage value H5 of the second contraction pulse P5 is changed corresponding to the ink temperature, may be combined, so that as the ink temperature rises, the pulse width T5 of the second contraction pulse P5 is made narrower and, at the same time, the voltage value H5 of the second contraction pulse P5 is made lower.

Also, Embodiment 1, wherein the pulse width T5 of the second contraction pulse P5 is changed corresponding to the ink temperature, and Embodiment 3, wherein the pulse width T5 of the second contraction pulse P5 is made longer for the ejecting waveform corresponding to the subsequent ink drop, may be combined, so that the pulse width T5 of the second contraction pulse P5 is adjusted to account for both ink temperature and the ejection velocity required to achieve drop integration, so that the pulse may become narrower as the ink temperature rises or wider as needed to integrate with a preceding ink drop.

Similarly, Embodiment 2 and Embodiment 4 may be combined, so that the voltage value H5 of the second contraction pulse P5 becomes lower as the temperature rises, and it becomes higher for the ejecting waveform corresponding to the subsequent ink drop.

In addition, other appropriate combinations of the constitutions disclosed in the various embodiments may also be used.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a pressure chamber for storing an ink;

an actuator for changing the volume of the pressure chamber;

a nozzle through which the ink stored in the pressure chamber is ejected when the volume of the pressure chamber is changed;

a temperature sensor for detecting the temperature of the ink; and a controller for controlling the actuator by outputting an ejecting waveform, the ejecting waveform sequentially including an expansion pulse, a first contraction pulse, and a second contraction pulse, wherein the controller changes a pulse width or a voltage value of the second contraction pulse when the temperature detected by the temperature sensor changes.

2. The inkjet head of claim 1, wherein the controller decreases the pulse width or the voltage value of the second contraction pulse when the temperature detected by the temperature sensor increases.

3. The inkjet head of claim 1, wherein the ejecting waveform Further comprises:

a first ground pulse between the expansion pulse and the first contraction pulse; and a second ground pulse between the first contraction pulse and the second contraction pulse.

4. The inkjet head of claim 3, wherein the pressure chamber and the ink stored therein has a resonance period, and the sum of the pulse widths of the expansion pulse, the first ground pulse, and the first contraction pulse is set to be less than one-half of the resonance period.

5. The inkjet head of claim 4, wherein the controller determines the resonance period based on the temperature detected by the temperature sensor.

6. The inkjet head of claim 4, wherein the controller sets the pulse width of the second ground pulse to be less than or equal to the resonance period.

7. The inkjet head of claim 1, wherein the controller outputs a plurality of ejecting waveforms in series, each ejecting waveform corresponding to an individual ink drop of a multi-drop ejection.

8. The inkjet head of claim 7, wherein the controller changes the pulse width or the voltage value of the second contraction pulse of at least one ejecting waveform in the series of ejecting waveforms.

9. The inkjet head of claim 8, wherein the controller changes the pulse width or the voltage value of the second contraction pulse of the at least one ejecting waveform to increase an ejection velocity of an ink drop.

10. The inkjet head of claim 9, wherein the controller increases the pulse width or the voltage value of the second contraction pulse of the at least one ejecting waveform when the temperature detected by the temperature sensor increases.

11. The inkjet head of claim 10, wherein each ejecting waveform further includes a first ground pulse between the expansion pulse and the first contraction pulse and a second ground pulse between the first contraction pulse and the second contraction pulse.

12. The inkjet head of claim 11, wherein the pressure chamber and the ink stored therein has a resonance period, and the sum of the pulse widths of the expansion pulse, the first ground pause, and the first contraction pulse is set to be less than one-half of the resonance period.

13. The inkjet head of claim 12, wherein the controller sets the pulse width of the second ground pulse to be less than or equal to the resonance period.

14. The inkjet head of claim 12, wherein the controller determines the resonance period based on the temperature detected by the temperature sensor.

15. An inkjet head comprising:

a pressure chamber for storing an ink;

an actuator for changing the volume of the pressure chamber;

a nozzle through which the ink stored in the pressure chamber is ejected when the volume of the pressure chamber is changed;

a temperature sensor for detecting the temperature of the ink; and a controller for controlling the actuator by outputting an ejecting waveform, the ejecting waveform sequentially including an expansion pulse, a first contraction pulse, and a second contraction pulse, wherein a first time period from a starting point of the expansion pulse to an end of the first contraction pulse is set to be shorter than half of a resonance period in the ink stored in the pressure chamber, and a second period from a middle point of the first time period to a middle point of the second contraction pulse is set to be shorter than the resonance period, and wherein the controller changes a pulse width or a voltage value of the second contraction pulse when the temperature detected by the temperature sensor changes.

16. The inkjet head of claim 15, wherein the controller decreases the pulse width or the voltage value of the second contraction pulse when the temperature detected by the temperature sensor increases.

17. The inkjet head of claim 15, wherein the ejecting waveform further comprises:

a first ground pulse between the expansion pulse and the first contraction pulse; and a second ground pulse between the first contraction pulse and the second contraction pulse.

18. The inkjet head of claim 17, wherein the controller determines the resonance period based on the temperature detected by the temperature sensor.

19. The inkjet head of claim 15, wherein the controller outputs a plurality of ejecting waveforms in series, each ejecting waveform corresponding to an individual ink drop of a multi-drop ejection.

20. The inkjet head of claim 19, wherein the controller changes the pulse width or the voltage value of the second contraction pulse of the at least one ejecting waveform to increase an ejection velocity of an ink drop.

* * * * *